US010954976B2

(12) United States Patent
Ilse et al.

(10) Patent No.: US 10,954,976 B2
(45) Date of Patent: Mar. 23, 2021

(54) DEVICE FOR CONTROLLING THE SWIRL OF A FLUID FLOWING IN A PIPELINE

(71) Applicant: ContiTech MGW GmbH, Hannoversch Muenden (DE)

(72) Inventors: Dennis Ilse, Landolfshausen (DE); Harald Kreidner, Hannoversch Muenden (DE); Holger Fassl, Calden (DE)

(73) Assignee: ContiTech MGW GmbH, Hannoversch Muenden (DE)

( * ) Notice: Subject to any disclaimer, the term of this patent is extended or adjusted under 35 U.S.C. 154(b) by 41 days.

(21) Appl. No.: 16/525,903

(22) Filed: Jul. 30, 2019

(65) Prior Publication Data

US 2020/0049176 A1 Feb. 13, 2020

(30) Foreign Application Priority Data

Aug. 8, 2018 (DE) ..... 10 2018 213 276.3

(51) Int. Cl.
*F15D 1/02* (2006.01)
*F15D 1/00* (2006.01)

(52) U.S. Cl.
CPC ..... *F15D 1/02* (2013.01); *F15D 1/001* (2013.01)

(58) Field of Classification Search
CPC ... F15D 1/02; F15D 1/025; F15D 1/04; F15D 1/001; G01F 1/40; G01F 1/34
USPC ..... 138/37, 39, 44; 366/338, 339; 73/861.66, 168
See application file for complete search history.

(56) References Cited

U.S. PATENT DOCUMENTS 3,733,900 A * 5/1973 De Baun ..... G01F 1/40 73/861.66
3,840,051 A * 10/1974 Akashi ..... G01F 1/40 138/37
4,142,413 A * 3/1979 Bellinga ..... G01F 15/00 73/198
4,280,360 A * 7/1981 Kobayashi ..... G01F 1/3209 73/198
5,363,699 A * 11/1994 McCall ..... F15D 1/02 73/198
5,529,084 A * 6/1996 Mutsakis ..... F15D 1/04 137/13
8,307,943 B2 * 11/2012 Klasing ..... F02K 3/075 181/210
8,485,230 B2 * 7/2013 Laor ..... F16L 55/02772 138/177

(Continued)

FOREIGN PATENT DOCUMENTS

DE 1489593 A1 6/1969
DE 102014105166 B3 8/2015
EP 0764833 A1 3/1997

*Primary Examiner* — Patrick F Brinson
(74) *Attorney, Agent, or Firm* — Gregory Adams; David Cate

(57) ABSTRACT

The invention relates to a device for controlling the swirl of a fluid (2, 7) flowing in a pipeline (1, 6), comprising a pipeline (1, 6) in which a fluid (2, 7) flows. The invention was based on the object of creating a device with which the adaptation of the swirl of a fluid (2, 7) flowing in a pipeline (1, 6) to the desired flow conditions in the pipeline (1, 6) is possible. Said object is achieved in that the device has at least one predetermined series of flow straighteners (5, 8) and swirl generators (4, 9, 10).

21 Claims, 2 Drawing Sheets

(56) References Cited

U.S. PATENT DOCUMENTS

Figure 1:
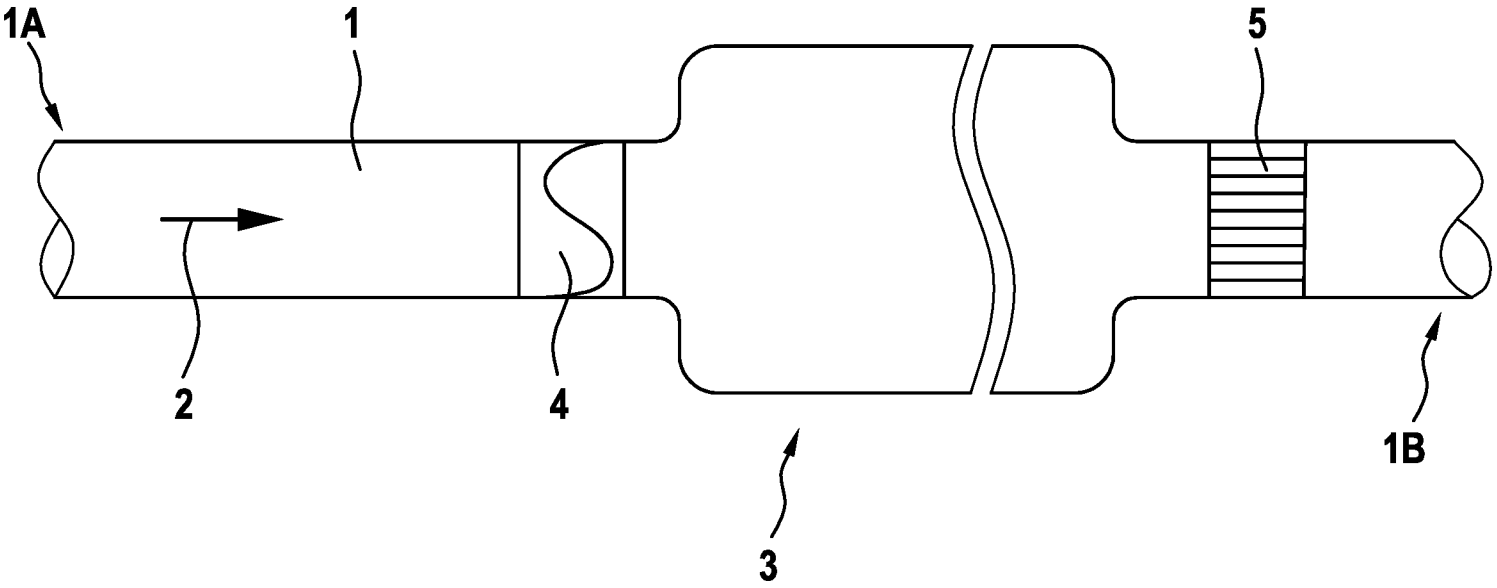

| | | | | |
|---|---|---|---|---|
| 2005/0263199 | A1* | 12/2005 | Meheen | F15D 1/0005 138/44 |
| 2008/0037366 | A1* | 2/2008 | Smith | G01F 15/00 366/337 |
| 2009/0139400 | A1* | 6/2009 | Bach | F01N 3/2892 95/45 |
| 2017/0370385 | A1* | 12/2017 | Reckner | G01F 25/0007 |
| 2018/0051944 | A1* | 2/2018 | Shin | F28F 13/12 |

* cited by examiner

DEVICE FOR CONTROLLING THE SWIRL OF A FLUID FLOWING IN A PIPELINE

The invention relates to a device for controlling the swirl of a fluid flowing in a pipeline, comprising a pipeline in which a fluid flows.

Fluids flowing through pipelines commonly exhibit swirl. For example, air that is compressed by an exhaust-gas turbocharger is set in rotation by the rotation of the exhaust-gas turbocharger, that is to say exhibits swirl in addition to the translational movement.

In order to improve efficiency, the charge air must be cooled, normally by means of a charge-air pre-cooler. Here, the available charge-air pre-coolers require particular flow conditions, for example pressure and swirl of the charge air.

Since pipelines generally have to be adapted to the installation conditions in the engine bay of a motor vehicle, bends in the profile of the pipeline are unavoidable. Such bends may, depending on bend radius and bend direction, generate different pressure losses, which are dependent on the swirl direction and the magnitude of the swirl of the fluid. Therefore, in the bend regions too, it is desirable not only to know the swirl of the flowing fluid but also to adapt it to the geometry of the pipelines.

Devices for measuring or for setting a swirl are already known from the prior art. In this regard, EP 0 764 833 A1 discloses a method in which, more accurately than with conventional rotor anemometers, the swirl in a pipe flow is able to be determined by means of differential pressure measurements.

Methods and devices for generating swirl in flowing media are also already known per se. The German utility model DE 1 489 593 U for instance discloses a throttle device which utilizes a settable device for swirl generation in order to impart a swirl to an air flow.

DE 10 2014 105 166 B3 has disclosed a swirl generator for a burner, in the case of which a selectable swirl is able to be generated through selectable variation of the position of a control blade in relation to static guide blades.

The invention was based on the object of creating a device with which the adaptation of the swirl of a fluid flowing in a pipeline to the desired flow conditions in the pipeline is possible.

Said object is achieved in that the device has at least one predetermined series of flow straighteners and swirl generators.

Such a series of flow straighteners and swirl generators makes it possible to generate a predetermined swirl in the flow in fluid lines at any desired, even multiple successive, predetermined locations.

In one refinement of the invention, in the flow direction of the fluid, each series firstly has a flow straightener.

The arrangement of a flow straightener as the first element of the series has the advantage that, for the element of the series which follows in each case, the flow no longer exhibits swirl, that is to say is laminar, which is advantageous as a starting point for the generation of a defined swirl.

In a further refinement of the invention, in the flow direction of the fluid, each series firstly has a swirl generator.

If the swirl of the flowing fluid is known when flowing into the series, said swirl is able to be intensified or reduced by the swirl generator according to the operating conditions. The swirl present is usable in this way.

In one refinement of the invention, each series consists of at least one flow straightener and at least one swirl generator.

In one refinement of the invention, each series consists of at least two swirl generators.

In one refinement of the invention, in the flow direction of the fluid, at least one swirl generator follows downstream of a flow straightener.

In one refinement of the invention, in the flow direction of the fluid, at least one flow straightener follows downstream of a swirl generator.

In one refinement of the invention, in the flow direction of the fluid, at least one further swirl generator follows downstream of a swirl generator.

The different arrangements of swirl generators and flow straighteners per series permit particularly good adaptation of the flow conditions in pipelines.

In one refinement of the invention, the swirl generator is a controllable swirl generator.

A controllable swirl generator has the advantage that, even in the case of changing boundary conditions, the swirl of the flow of the fluid is still able to be set well.

An example of the invention will be explained in more detail below on the basis of the drawing. FIG. 1 shows a basic illustration of a device according to the invention with a section of a pipeline 1 through which a fluid 2 (symbolized by an arrow here) flows.

The pipeline 1 has a widened region 3, which is formed in a manner known per se (and not shown in more detail here) as a charge-air cooler.

In the example provided, the fluid 2 exhibits a laminar flow in a first region 1A of the pipeline 1. By way of a swirl generator 4 (illustrated merely symbolically here), a predetermined swirl is able to be imparted to the fluid 2 such that the fluid 2 is able to be conducted through the charge-air cooler 3 with turbulent flow.

In a second region 1B of the pipeline 1, which is arranged following the charge-air cooler 3 in the flow direction of the fluid 2, a flow straightener 5 (likewise illustrated merely symbolically) is arranged. By way of the flow straightener 5, the fluid 2 flowing from the charge-air cooler 3 in a turbulent manner is able to be transformed back into a laminar flow.

Figure 2:
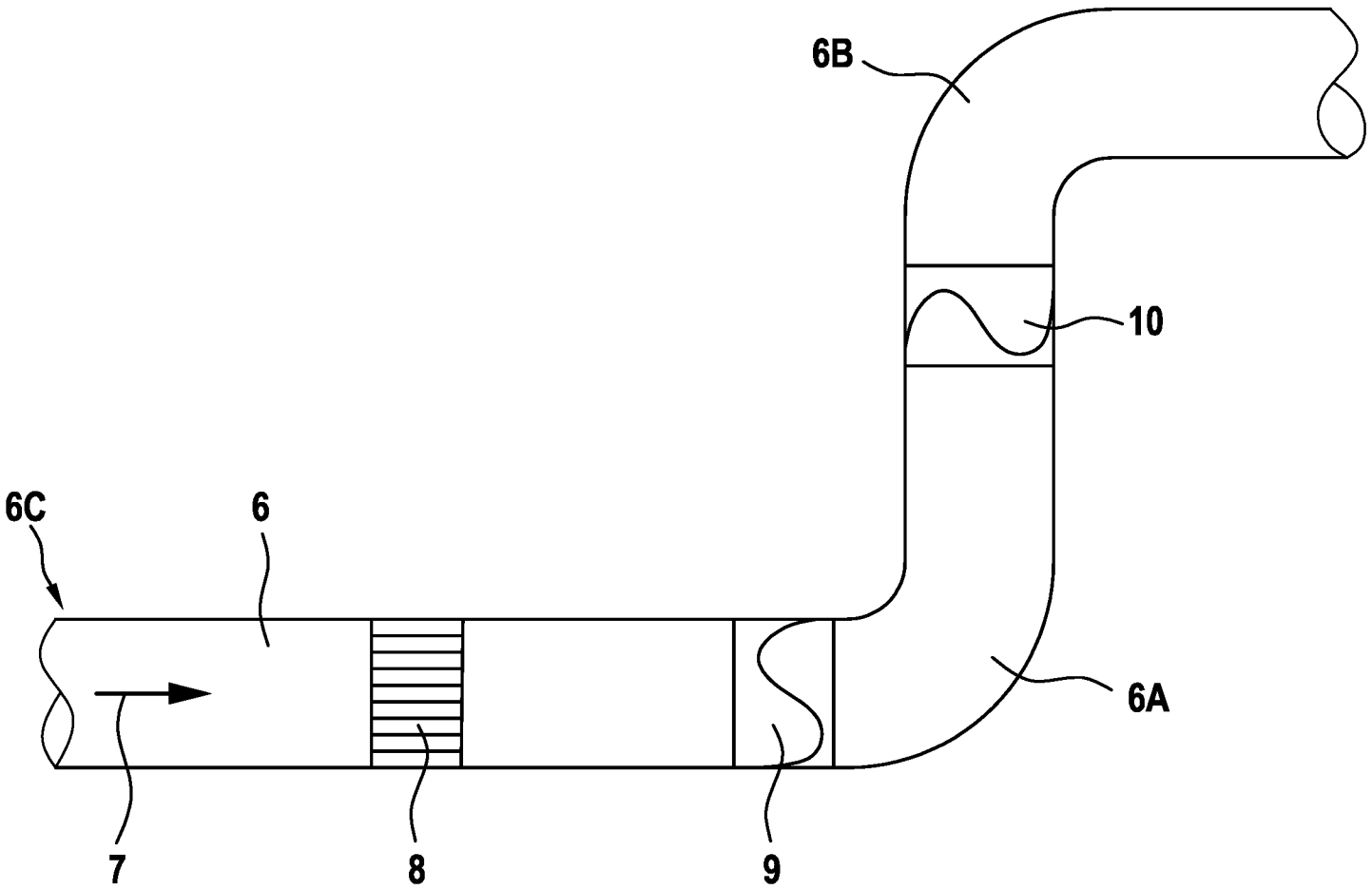

FIG. 2 shows a section of a curved pipeline 6 having two bends 6A and 6B. A flowing fluid 7 (symbolized merely as arrow 7 here) is conducted through the pipeline 6.

In this example, the fluid 7 flowing in at a first end 6C exhibits an unknown swirl.

In the section shown, in the flow direction of the fluid 7, the pipeline 6 firstly has a flow straightener 8, by way of which the fluid 7 is able to be transformed into a laminar flow. Arranged downstream of the flow straightener 8 and upstream of the bend 6A of the pipeline 6 in the flow direction of the fluid 7 is a swirl generator 9, by way of which the flow of the fluid 7, which is laminar here, is able to be transformed into a turbulent flow with a predetermined swirl magnitude and swirl direction, which is matched to the bend 6A of the pipeline 6.

In a swirl generator 10 which follows in the flow direction of the fluid 7, it is once again possible to intensify the swirl of the flowing fluid 7 upstream of the bend 6B of the pipeline 6, such that the fluid 7 is able to be conducted through the bend 6B with an optimal flow.

LIST OF REFERENCE SIGNS

Part of the Description

1 Pipeline
1A First section of the pipeline 1
2 Fluid in the pipeline 1
3 Widened region of the pipeline 1, charge-air cooler
4 Swirl generator in the pipeline 1

5 Flow straightener in the pipeline 1
6 Curved pipeline
6A, 6B Bends of the pipeline 6
7 Fluid in the pipeline 6
8 Flow straightener in the pipeline 6
9, 10 Swirl generators in the pipeline 6

The invention claimed is:

1. A device for controlling the swirl of a fluid flowing in a pipeline, the device comprising:

a pipeline in which a fluid flows; wherein the pipeline is configured to convert an unknown swirl and unknown swirl magnitude of the fluid to a predetermined swirl and a predetermined swirl magnitude;

wherein the device has at least one predetermined series of flow straighteners and swirl generators; and wherein the pipeline includes a charge-air cooler in a first section of the pipeline and the charge-air cooler introduces turbulence into the fluid to at least partially generate the unknown swirl of the fluid and wherein the charge-air cooler uses the fluid to cool a charge air.

2. The device as claimed in claim 1, wherein, in the flow direction of the fluid, each series firstly has a flow straightener.

3. The device as claimed in claim 1, wherein, in the flow direction of the fluid, each series firstly has a swirl generator.

4. The device as claimed in claim 1, wherein each series consists of at least one flow straightener and at least one swirl generator.

5. The device as claimed in claim 1, wherein each series consists of at least two swirl generators.

6. The device as claimed in claim 1, wherein, in the flow direction of the fluid, at least one swirl generator is arranged downstream of a flow straightener.

7. The device as claimed in claim 1, wherein, in the flow direction of the fluid, at least one flow straightener is arranged downstream of a swirl generator.

8. The device as claimed in claim 1, wherein, in the flow direction of the fluid, at least one further swirl generator is arranged downstream of a swirl generator.

9. The device as claimed in claim 1, wherein the swirl generator is a controllable swirl generator.

10. A device for controlling the swirl of a fluid flowing in a pipeline, the device comprising:

a pipeline in which a fluid flows;

wherein the pipeline is configured to convert an unknown swirl and unknown swirl magnitude of the fluid to a predetermined swirl and a predetermined swirl magnitude; and wherein the pipeline includes a charge-air cooler in a first section of the pipeline and the charge-air cooler introduces turbulence into the fluid to at least partially generate the unknown swirl of the fluid and wherein the charge-air cooler uses the fluid to cool a charge air.

11. The device of claim 10, wherein the pipeline includes the charge-air cooler in a downstream section of the pipeline.

12. The device of claim 11, wherein the charge-air cooler requires the fluid to have the predetermined swirl and the predetermined swirl magnitude.

13. The device of claim 11, wherein the pipeline includes a swirl generator located upstream of the charge-air cooler and configured to at least partially generate the predetermined swirl of the fluid.

14. The device of claim 10, wherein the pipeline includes a flow straightener to convert the unknown swirl of the fluid into a laminar flow and a swirl generator downstream of the flow straightener, wherein the swirl generator generates the laminar flow into the predetermined swirl.

15. The device of claim 10, wherein the pipeline includes one or more bends.

16. The device of claim 10, wherein the pipeline is straight.

17. A device for controlling the swirl of a fluid flowing in a pipeline, the device comprising:

a pipeline in which a fluid flows;

wherein the pipeline is configured to convert an unknown swirl and unknown swirl magnitude of the fluid to a predetermined swirl and a predetermined swirl magnitude; and wherein the pipeline comprises a first section through which the fluid flows, a swirl generator located downstream of the first section that transforms the fluid to have a first swirl direction and a first swirl magnitude, a charge-air cooler located downstream of the swirl generator and a flow straightener located downstream of the charge-air cooler.

18. The device of claim 10, wherein the pipeline includes a first section through which the fluid flows, a straightener located downstream of the first section, a swirl generator located downstream of the straightener, and a band located downstream of the swirl generator, wherein the swirl generator intensifies a swirl of the fluid to facilitate conduction of the fluid through the bend.

19. The device of claim 18, further comprising a second swirl generator located downstream of the bend and a second bend located downstream of the second swirl generator, wherein the second swirl generator intensifies a second swirl of the fluid to facilitate conduction of the fluid through the second bend.

20. The device of claim 17, wherein the pipeline includes one or more bends.

21. The device of claim 17, further comprising a second swirl generator located downstream of a bend and a second bend located downstream of the second swirl generator, wherein the second swirl generator intensifies a second swirl of the fluid to facilitate conduction of the fluid through the second bend.

* * * * *